US007357587B2

(12) United States Patent
D'Angelo

(10) Patent No.: US 7,357,587 B2
(45) Date of Patent: Apr. 15, 2008

(54) UNIVERSAL LIQUID DISPENSER

(75) Inventor: Eduardo Felipe D'Angelo, Miami, FL (US)

(73) Assignee: Eduardo F. D'Angelo, Miami, FL (US)

( * ) Notice: Subject to any disclaimer, the term of this patent is extended or adjusted under 35 U.S.C. 154(b) by 183 days.

(21) Appl. No.: 11/247,531

(22) Filed: Oct. 11, 2005

(65) Prior Publication Data

US 2006/0083578 A1 Apr. 20, 2006

Related U.S. Application Data

(60) Provisional application No. 60/619,649, filed on Oct. 16, 2004.

(51) Int. Cl.
*A47L 1/08* (2006.01)
*A47L 13/12* (2006.01)

(52) U.S. Cl. ..... 401/25; 401/34; 401/206; 401/270

(58) Field of Classification Search ..... 401/34–39, 401/261, 263, 264–266, 270–275, 278, 279, 401/16–19, 23–27, 205, 206
See application file for complete search history.

(56) References Cited

U.S. PATENT DOCUMENTS 190,644 A * 5/1877 Swift ..... 401/23
282,148 A * 7/1883 Armington ..... 401/23
2,724,850 A * 11/1955 Howard et al. ..... 401/17
4,035,090 A * 7/1977 Bavaveas ..... 401/25
4,229,116 A 10/1980 Moore
4,826,340 A 5/1989 Rothweiler
4,848,713 A * 7/1989 Adams ..... 248/206.2
5,214,820 A 6/1993 Shumway
5,336,330 A 8/1994 Shumway
5,454,659 A 10/1995 Vosbikian
5,558,452 A * 9/1996 Oka et al. ..... 401/6
6,095,709 A 8/2000 Armer
6,210,064 B1 4/2001 White
RE37,190 E 5/2001 Stowell
6,224,283 B1 5/2001 Hay
6,250,833 B1 6/2001 Perry
D446,898 S 8/2001 Brewer
6,330,948 B1 * 12/2001 Leto ..... 211/70.6
6,425,701 B1 7/2002 Jacobs
6,439,790 B1 8/2002 Kay
6,543,950 B1 * 4/2003 Huang ..... 401/6
D475,824 S 6/2003 Libman
6,629,799 B2 10/2003 Flores
6,663,309 B2 * 12/2003 Zamansky et al. ..... 401/264

* cited by examiner

*Primary Examiner*—Huyen Le

(57) ABSTRACT

A liquid dispenser first contains, then dispenses a cleaning solution, and finally might be used to scrubs or cleans a dirty surface. The dispenser has a hollow handle that serves as a reservoir for the cleaning solution and at each end of the handle a cleaning implement; specifically a scrubber and a sponge. When a user presses the selected implement against a cleaning surface, a valve is opened, allowing the cleaning solution to flow. The user might then scrub a dirty surface.

16 Claims, 5 Drawing Sheets

UNIVERSAL LIQUID DISPENSER

CROSS-REFERENCE TO RELATED APPLICATION

This application claims the benefit of U.S. Provisional Patent Application Ser. No. 60/619,649, filed Oct. 16, 2004.

BACKGROUND OF THE INVENTION

1. Introduction

Cleaning by definition is a chore. And it can get tough. Hot, soapy water dries and irritates delicate hands. Man has invented tools to make cleaning easier. For example, rubber dish gloves and handled brushes. However, gloves are awkward, and make things more complicated. Further, handled cleaning devices have their own drawbacks. Some are difficult to manipulate.

Soap dispensing cleaning devices are known in the art. However, most do not efficiently dispense cleaning solutions, or involve such a complicated mechanism they are impractical for large commercial exploitation.

2. Field of the Invention

The present invention relates to a liquid dispenser. More specifically a dispenser that contains and dispenses a cleaning solution while the dispenser scrubs or cleans a dirty surface 3. Description of the Prior Art U.S. Pat. No. 4,229,116 to Moore. Is titled, "Liquid Soap Dispenser and Brush Combination." The combination features a liquid soap dispenser with a rotatably mounted soap container and a brush. To dispense soap the dispenser rotates in one direction to dispose liquid soap, and rotates in an opposite direction to block passage of soap to the brush.

U.S. Pat. No. 4,826,340 to Rothweiler et al. is titled "Hand Brush". The Brush's handle contains a soap solution and a valve allows a user to start and stop the flow of the solution to the cleaning brush.

U.S. Pat. No. 5,336,330 to Shumway et al. is titled "Method for Cleaning an Interior Cavity of Dishware". The method requires the use of a differentiated scrubber to clean a cylindrical dishware cavity.

U.S. Pat. No. 5,454,659 to Vosbikian et al. is titled "Liquid Dispensing Implement". A hollow handle stores a soapy cleaning solution, which allows the solution to continually flow to a porous applicator.

U.S. Pat. No. 6,095,709 to Armer et al. is titled "Liquid Soap Dispensing and Scrub Brush". Armer essentially teaches an apparatus for dispensing a liquid onto a cleaning surface.

U.S. Pat. No. 6,210,064 B1 to White et al. is titled "Soap-Fillable Brush with Sealed Actuator". White's Actuator controls the flow of soap to a cleaning brush. A user presses down on the actuator to release the soap.

U.S. Pat. No. 6,224,283 B1 to Hay is titled "Hand-Held Cleaning Device". Hay teaches an actuator that when compressed allows a cleaning solution to contact the device's brush and eventually the dirty surface to be cleaned.

U.S. Pat. No. 6,250,833 B1 to Perry et al. is self-explanatorily titled "Soap-Dispensing Kitchen Brush". Perry's brush implements a mechanism similar to that described by Rothweiler et al., above.

U.S. Pat. No. D446,898 S to Brewer et al. is titled "Dish Scrubber", and teaches an ornamental design for the same.

U.S. Pat. No. 6,425,701 B1 to Jacobs is titled "Liquid Dispensing Handle". Jacobs's handle implements a mechanism similar to that described by Vosbikian et al., above.

U.S. Pat. No. 6,439,790 B1 to Kay is titled "Soap Brush". The housing contains soapy solution for application to a brush for cleaning a dirty surface.

U.S. Pat. No. 6,629,799 B2 to Flores, Jr. is titled "Bristled Soap Dispenser". Here the dispenser has ducts connected to a pump, which transfers soap from an internal reservoir to exterior, cleaning bristles.

U.S. Pat. No. 6,705,492 B2 to Lowry is titled "Bottom Dispensing Liquid Soap Dispenser". In contrast to the references described above, Lowry's dispenser only dispenses soap and relies on other devices to put the soap to use.

BRIEF SUMMARY OF THE INVENTION

It is an object of the present invention to provide a liquid dispenser for cleaning an assortment of surfaces, by allowing a user to select from one of two applicators. Both applicators are attached, eliminating the inconvenience of exchanging surfaces before commencing a cleaning project.

Another object of the present invention is to provide a liquid dispenser for storage and dispensing of a cleaning solution, such as liquid soap.

A further object of the present invention is to provide a liquid dispenser with a replacement kit allowing a user to replace worn applicators while enjoying years of continuous use from the liquid dispenser. The user saves money, and environmentally harmful refuge is reduced.

A further object of the present invention is to provide a liquid dispenser having a holder so that the liquid dispenser might be placed within easy, practical reach of a user.

These and other objects of the invention are accomplished by providing a liquid dispenser for an assortment of liquids having a handle with a porous applicator at each end of the handle. One applicator is a sponge, ideal for standard cleaning and having a shape allowing access to tight spaces. The other applicator is a scrubber, also porous, but formed of a harder material for tougher cleaning. The handle is hollow, defining a cavity for liquid storage. When a user presses the selected applicator against a surface to be cleaned, a valve is opened allowing the stored liquid to flow out of the reservoir, through the porous applicator, and on to the surface to be cleaned. The handle has a plurality of non-slippery rings to help one grasp the liquid dispenser and a larger, a wide non-slippery band generally disposed in the center of the handle to allow the dispenser to be mounted to a holder.

Other objects and further scope of applicability of the present invention will become apparent from the detailed description given hereinafter. However, it should be understood, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE SEVERAL VIEWS OF THE DRAWING

The present invention will be better understood from the detailed description given herein below and the accompanying drawings with which are given by way of illustration only.

DETAILED DESCRIPTION OF THE INVENTION

Figure 1:
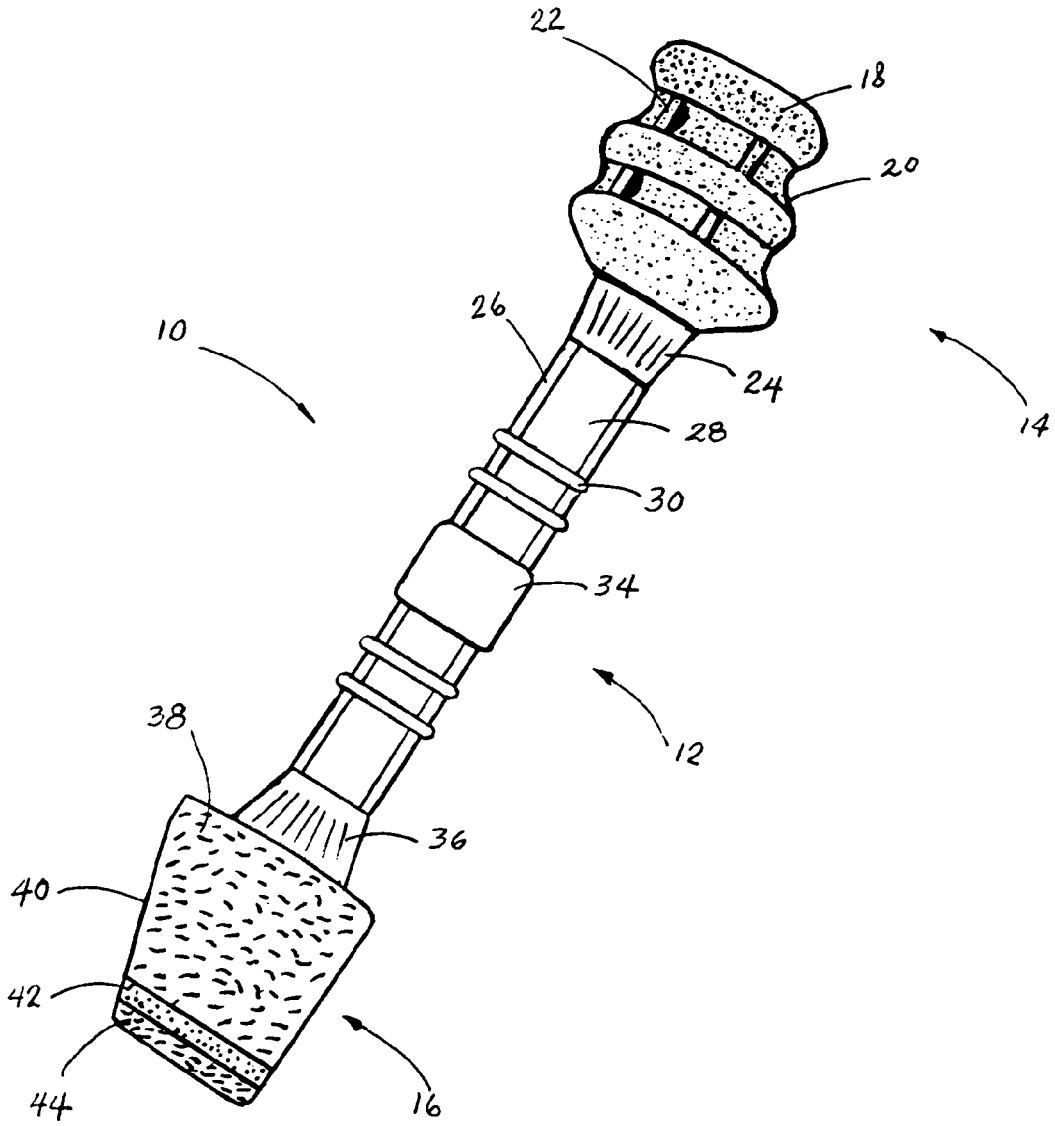
FIG. 1 is a view of the liquid dispenser of the present invention.

The Liquid Dispenser of the present invention is illustrated in FIG. 1, and designated generally by reference numeral 10. With reference now to the drawings, and in particular to FIG. 1, the liquid dispenser is seen to feature three basic components, namely: a handle member 12, an applicator sponge 14 at the end of the handle member and an applicator scrubber 16 at the other end. Each of these components will be discussed in detail below.

The handle member 12, which includes a general cylindrical sidewall 26, preferably formed of a transparent or translucent material, such as a suitable plastic. The handle member 12 is hollow, forming a reservoir 28 for the placement of a liquid medium, generally liquid soap, allowing the liquid to reach the applicator sponge 14 and the applicator scrubber 16 attached at opposite ends of the handle member 12.

Figure 5:
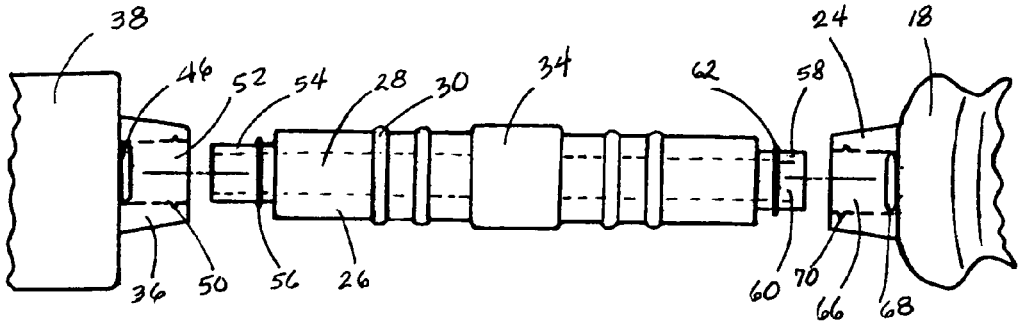
FIG. 5 is an exploded view of the liquid dispenser of the present invention illustrating the coupling mechanism of the applicator sponge and scrubber to the handle member.

The handle member 12 includes a cylindrical section 54, 58 with small diameter than the cylinder 26, used for the coupling to the applicator sponge 14 and the applicator scrubber 16 respectively, as illustrated in FIG. 5. The cylindrical section 54 has a flexible and resilient rubber ring 56 attached. The cylindrical section 58 has another flexible and resilient rubber ring 62 attached to this section. Rubber ring 62 will lock the connection with the applicator sponge 14 when it is inserted. This locking mechanism will be later described. The same will happen with the rubber ring 56 related with the insertion of the applicator scrubber 16.

The handle member 12 has in its surface a wide non-slippery band 34 for grasping firmly the handle member 12. Further, this non-slippery rubber band 34 is located where the holder 138 in FIG. 18, later described, will hold the universal liquid dispenser 10. The handle member 12 includes a number of non- slippery rubber rings 30 help to grasp the handle member 12 appropriately.

Figure 6:
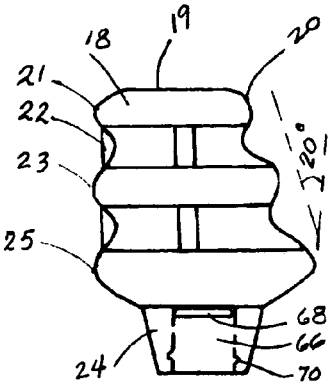
FIG. 6 is a side view of the applicator sponge of the liquid dispenser of the present invention.
Figure 7:
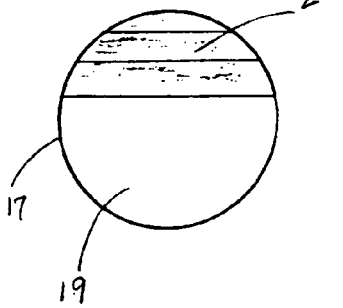
FIG. 7 is a longitudinal view of the applicator sponge of the liquid dispenser of the present invention.
Figure 8:
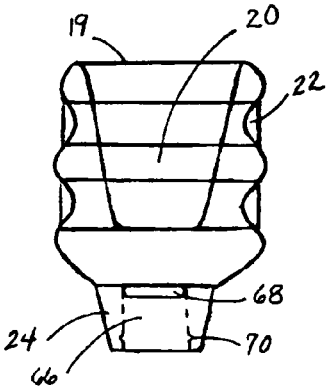
FIG. 8 is a side view of the applicator sponge of the liquid dispenser of the present invention with the inclined surface facing outward.

The applicator sponge 14 has a specific external shape, allowing reaching any surface to be cleaned as best illustrated in FIGS. 6, 7 and 8. It has a cylindrical surface 17 used when the surface to be cleaned is cylindrical, like a glass. The waved surface 21, 23, 25 and a number of sponge filaments 22 placed between the waves; help clean the cylindrical surface, too. The applicator sponge 14 has an inclined surface 20 with an angle of approximately twenty (20) degrees related with the longitudinal axis of the handle member 12 to clean the surface of dishes. The applicator sponge 14 has a flat surface 19 to clean the bottom of any recipient.

Figure 9:
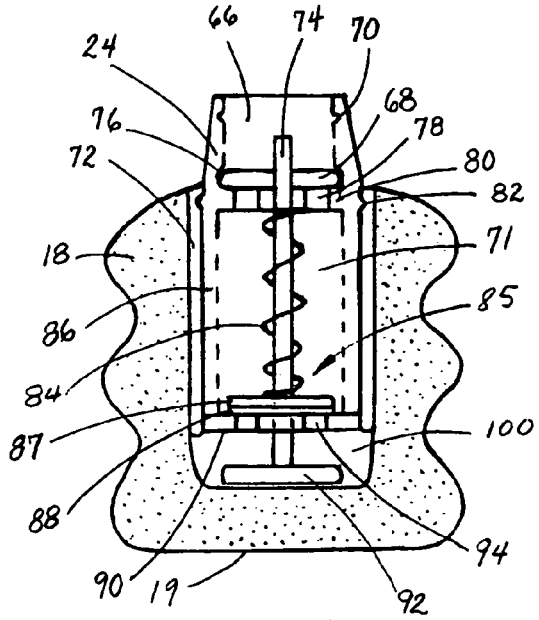
FIG. 9 is a cross-sectional view of the applicator sponge of the liquid dispenser of the present invention illustrating the sponge valve mechanism.

The applicator sponge 14 includes a sponge-end protuberance 24 for coupling with the handle member 12. The sponge-end protuberance 24 has an internal cylinder 66, allowing to insert the cylindrical section 58 belong to the handle member 12. The internal cylinder 66 has at the end a flange 76 to hold a flexible and resilient rubber ring 68, as illustrated in FIG. 9. The rubber ring 68 seals the connection between the applicator sponge 14 and the handle member 12. The internal cylinder 66 has a cylindrical groove 70 to lock the connection when the rubber ring 62 reach the cylindrical groove 70, avoiding to disengage the coupling between the applicator sponge 14 and the handle member 12. The rubber ring 62 works as a sealer, too.

Figure 11:
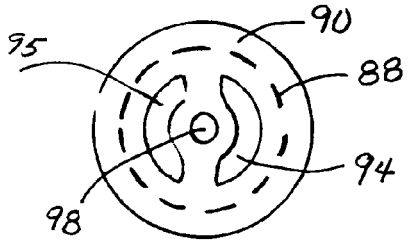
FIG. 11 is a view of the base wall of the housing of the applicator sponge of the present invention.

Internally, the applicator sponge 14 has a housing 71 which includes a generally cylindrical internal side wall 86, preferred formed of a plastic material as illustrated in FIG. 9. The external sidewall 86 is non-cylindrical. The housing 71 has a base wall 90 secured to the sidewall 86. The base wall 90 has an axial bore 98 and two holes 94,95, as illustrated in FIG. 11. The housing 71 has a valve assembly 85.

Figure 10:
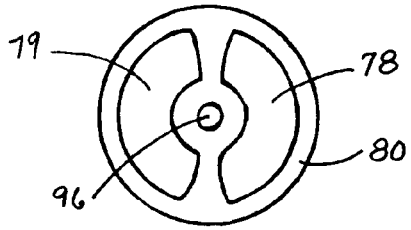
FIG. 10 is a view of the upper wall of the housing of the applicator sponge of the present invention.

The valve assembly 85 allows the flow of liquid to the sponge material 18, when it is activated. The valve assembly 85 includes an elongated valve stem 74 extending axially through the housing 71 and the axial bore 98. The housing 71 has an upper wall 80. The upper wall 80 has an axial bore 96 and two holes 78,79, as illustrated in FIG. 10.

The valve stem 74 moves through the axial bore 96 and axial bore 98. The two holes 78, 79 always allow the flow of the liquid from the handle member 12 to the housing 71. The valve stem 74 has a round plate 92 attached at the lower end. The valve stern 74 has attached rigidly another round plate 87 inside the housing 71. The round plate 87 has glued in the bottom a flexible and resilient rubber plate 88. There is a spring 84 around the valve stem 74 and between the upper wall 80 and the round plate 87.

Normally, the rubber plate 88 is touching the base wall 90 covering the holes 94,95 of the base wall 90, because the spring 84 is pressuring the round plate 87 and round plate 88 against the base wall 90. This avoids the liquid inside the housing 71 to go to the sponge material 18.

The valve assembly 85 is activated when the person holding the universal liquid dispenser 10, press the applicator sponge 14 by the bottom surface 19 and pushing against any solid surface. Then the round plate 92 is moving up and the round plate 87 with the rubber plate 88 will move up, too, allowing the liquid inside the housing 71 to go through the holes 94,95 to the chamber 100 and to the sponge material 18. In this moment the spring 84 is compressed.

The flow of the liquid to the sponge material 18, generally soap, will stop when the valve assembly 85 is not pushing against a solid surface. Then, the compressed spring 84 push the round plate 87 and rubber plate 88, and the spring 84 recovers his original position. The rubber plate 88 will block again the holes 94,95.

Figure 15:
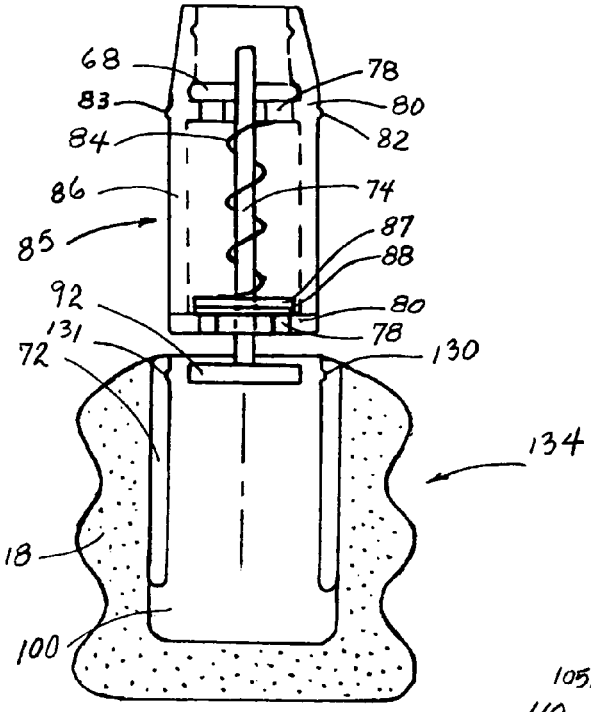
FIG. 15 is a cross-sectional view of the applicator sponge of the liquid dispenser of the present invention illustrating the sponge valve mechanism removed from the sponge material.
Figure 16:
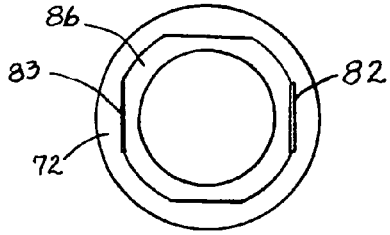
FIG. 16 is a view of the sponge valve mechanism locking into the non-cylindrical internal wall of the sponge material.

The applicator sponge 14 comprises two parts that can be disassembled for the purpose of replacement part as illustrated in FIG. 15. One part is composed of the housing 71 including the valve assembly 85. The second part (the replacement part) 134 is composed of the sponge material 18 and a non-cylindrical wall 72, generally made of plastic material, as illustrated in FIG. 16. The external side of the wall 72 is cylindrical and attached to the sponge material 18 with glue.

The housing 71, which has a non-cylindrical external side of the wall 86, is inserted inside the non-cylindrical internal wall 72 to form the applicator sponge 14, as illustrated in FIGS. 15-16. This coupling between two non-cylindrical surface, avoids the rotational movement could be created during the use of the applicator sponge 14. The sidewall 86 has two flanges 82,83. The non-cylindrical internal wall 72 of the replacement part has two grooves 130,131 allowing locking the replacement part 134 to the housing 71.

Figure 2:
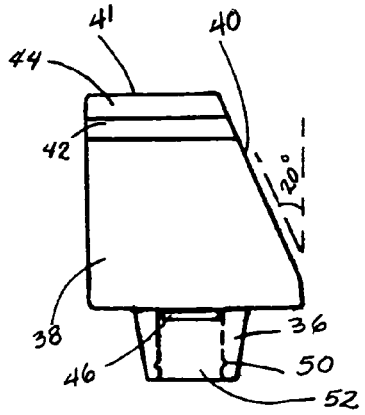
FIG. 2 is a side view of the applicator scrubber of the liquid dispenser of the present invention.
Figure 3:
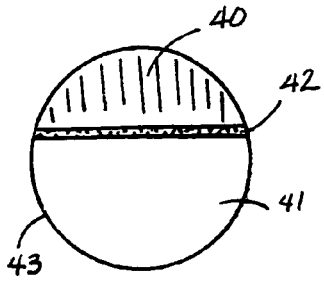
FIG. 3 is a longitudinal view of the applicator scrubber of the liquid dispenser of the present invention.
Figure 4:
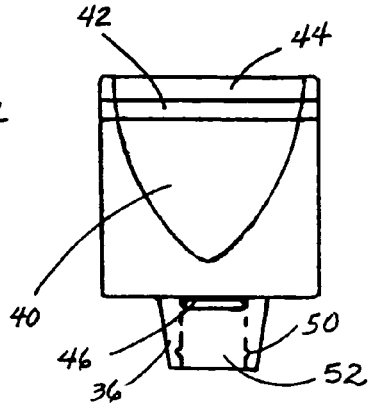
FIG. 4 is a side view of the applicator scrubber of the liquid dispenser of the present invention with the inclined surface facing outward.

The applicator scrubber 16 has an external shape able to reach any surface to be cleaned, as best illustrated in FIGS. 2, 3 and 4. The applicator scrubber 16 is used when a tough job is necessary to clean a specific surface.

FIG. 3 shows a top plan view of the applicator scrubber 16 with a cylindrical surface 43 ideal to clean a cylindrical surface. Further, the applicator scrubber 16 has a flat surface 41 to clean the bottom of any recipient and an inclined surface 40 to clean, per example, the surface of a frying pan or pot. The inclined surface 40 has approximately an angle of twenty (20) degrees with respect to the longitudinal axis of the universal liquid dispenser 10. The applicator scrubber 16 uses a non-scratch scour pad avoiding the damage of any surface to be cleaned.

The applicator scrubber 16 has four sections. The main section is the surface 38 made of non-scratch scour pad. There is a top section 44 that is made of non-scratch scour pad, too. Between these two sections, there is a small sponge section 42 to allow the movement of the section 44. This will be described later. The last section is a scrubber-end protuberance 36 used for coupling the applicator scrubber 16 and the handle member 12. The scrubber-end protuberance 36 has an internal cylinder 52 allowing to insert the cylindrical section 54 belong to the handle member 12.

Figure 12:
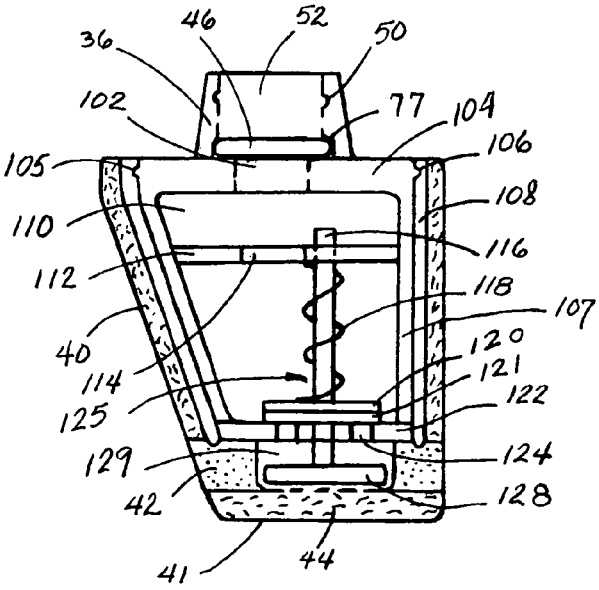
FIG. 12 is a cross-sectional view of the applicator scrubber of the liquid dispenser of the present invention illustrating the scrubber valve mechanism.

The internal cylinder 52 has at the end a flange 77 as illustrated in FIG. 12, to hold a flexible and resilient rubber ring 46 to seal the connection between the applicator scrubber 16 and the handle member 12. The internal cylinder 52 has a cylindrical groove 50. When the flexible and resilient rubber ring 56 belongs to the handle member 12 reach the cylindrical groove 50, it will lock the connection between the applicator scrubber 16 and the handle member 12. The rubber ring 56 can work as a sealer, too.

Internally the applicator scrubber 16 has a housing 110, which includes a truncated cylindrical wall 107. The side of the inclined surface 40 exist truncates it, as illustrated in FIG. 12. The housing 110 includes a valve assembly 125. The truncated cylindrical wall 107 is preferably made of a plastic material. The housing has a base wall 122 secured to the truncated cylindrical wall 107. The base wall 122 has a bore 126 and two holes 123,124 as illustrated in FIG. 14.

The housing has an upper wall 104. The upper wall 104 has a hole 102 to allow the communication with the handle member 12. The housing has a plate 112 close to the upper wall 104. The plate 112 has a bore 115 and a hole 114.

Figure 13:
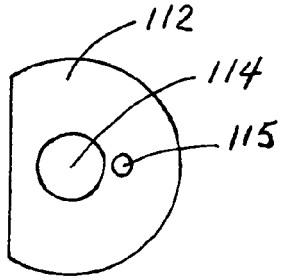
FIG. 13 is a view of the plate of the scrubber valve mechanism.
Figure 14:
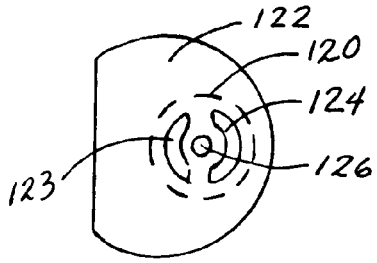
FIG. 14 is a view of the base wall of the housing of the applicator scrubber of the present invention.

The valve assembly 125 includes an elongated valve stem 116 extending vertically through the housing 110 and goes through the bore 126 in the base wall 122 and through the bore 115 in the plate 112, as illustrated in FIGS. 12, 13 and 14. The plate 112 has the hole 114 to permit the liquid to flow inside the housing 110. The valve stem 116 has a rigid round plate 128 attached at the lower end. The valve stem 116 has attached another rigid round plate 120 located inside the housing 110. The rigid round plate 120 has glued in the bottom a flexible and resilient rubber plate 121.

There is a spring 118 around the valve stem 116 and between the plate 112 and the round plate 120. Normally the rubber plate 121 is touching the base wall 122 covering the holes 123,124, because the spring 118 is pressuring the round plate 120 and rubber plate 121 against the base wall 122, avoiding the liquid inside the housing 110 to go outside through the sponge section 42 and non-scratch scour pad top section 44.

The valve assembly 125 is activated when the person holding the universal liquid dispenser 10 press the applicator scrubber 16 by the bottom surface 41 and pushing against any solid surface. The round plate 128 is moving up and the rigid round plate 120 with the rubber plate 121 moving up, too. This is possible because the sponge section 42 can be compressed. The liquid will flow from the housing 110 to the chamber 129 through the holes 123,124 existing in the base wall 122. The liquid flows to the sponge section 42 and non-scratch top section 44, too. In this moment the spring 118 is compressed. The flow of the liquid to the exterior will stop when the bottom of the applicator scrubber is not longer pushing any solid surface. In this case the compressed spring 118 returns to his original position, pushing the round plate 120 and rubber plate 121 against the base wall 122. The rubber plate 121 blocks the flow of liquid.

Figure 17:
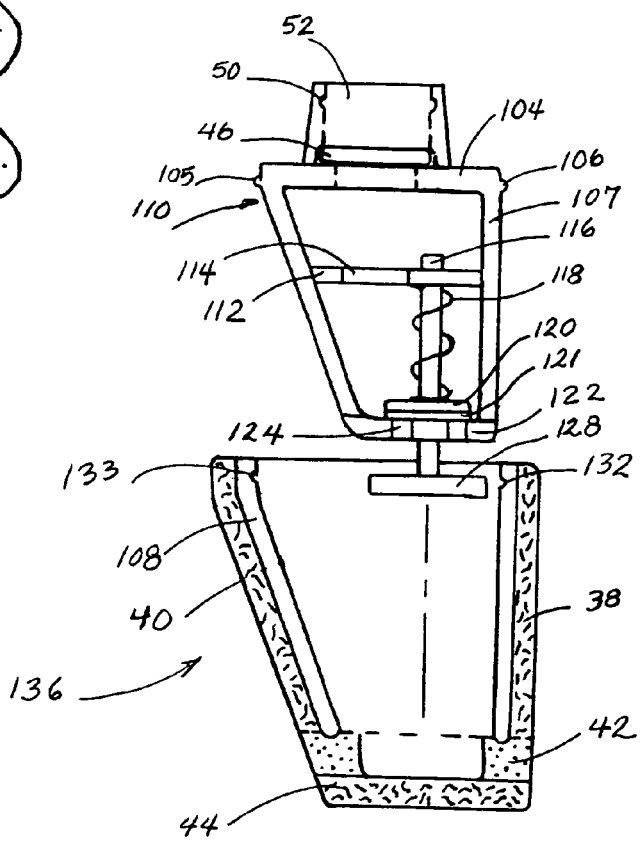
FIG. 17 is a view of the applicator scrubber disassembled into applicator scrubber replacement part and the scrubber valve mechanism.

The applicator scrubber 16 comprises two parts that can be disassembled for the purpose of replacement part, as illustrated in FIG. 17. One part is composed of the housing 110 including the valve assembly 125. The second part (the replacement part) 136 is composed of the non-scratch sections 38, 44 and the sponge section 42 externally, and the truncated cylinder 108, generally made of plastic material. The truncated cylinder 108 is attached with glue to the non-scratch scour pad 38. The sponge section 42 is glued to the non-scratch scour pad top section 44 for one side. For the other side the sponge section 42 is glued to the non-scratch scour pad 38.

The housing 110 is inserted inside the replacement part 136 to form the applicator scrubber 16 as illustrated in FIG. 17.

The sidewall 107 belong to the housing 110 has two flanges 105, 106. The truncated cylinder 108 belong to the replacement part 136 has two grooves 132, 133, allowing to lock the replacement part 136 to the housing part 110 when they are coupling.

Figure 18:
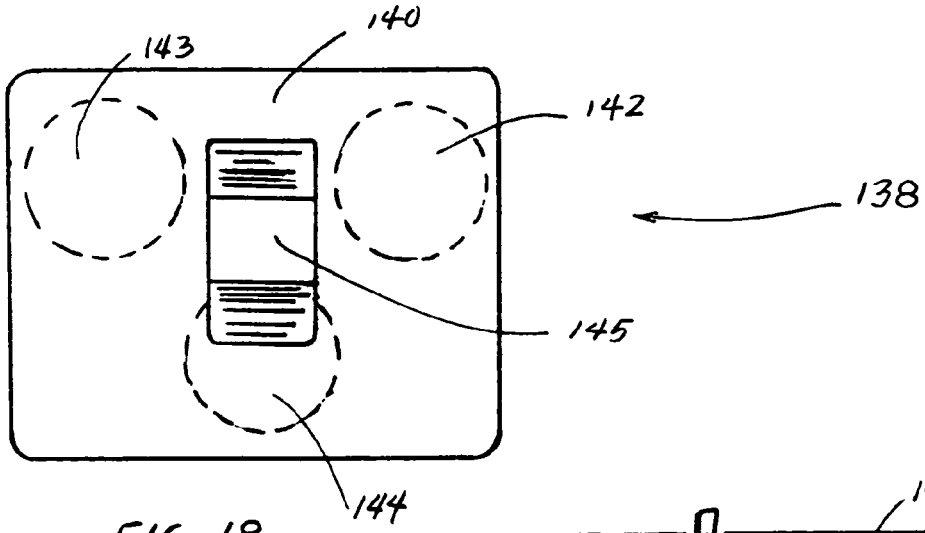
FIG. 18 is a view of the holder for the liquid dispenser of the present invention.
Figure 19:
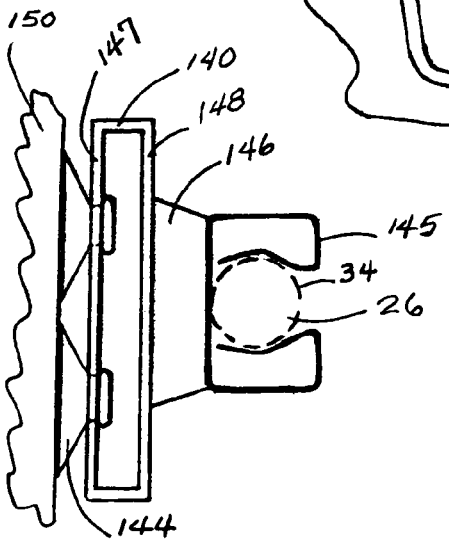
FIG. 19 is a cross-sectional view of the holder for the liquid dispenser of the present invention

There is a holder 138 as illustrated in FIG. 18 to put the universal liquid dispenser 10 in any place. The holder 138 comprises a frame 140, generally made of plastic material, three cylindrical rubber suction pads 142,143 and 144 and a clamp 145, generally made of plastic or metal as best illustrated in FIGS. 18,19.

The plastic frame 140 is generally a rectangular box and support the three suction pads 142, 143 and 144. They are attached to the frame 140 through the internal wall 147. The other sides of suction pads 242, 243 and 244 are in the surface 150. The frame 140 has an external wall 148. There is a piece of plastic 146 attached to the external wall 148 to get a prudential distance between the surface 150 and the universal liquid dispenser 10. The piece of plastic 146 is secured attached to the clamp 145. The clamp 145 will hold the universal liquid dispenser 10 through the rubber 34 located in the handle member 12 as illustrated in FIG. 1 and FIG. 19.

Figure 20:
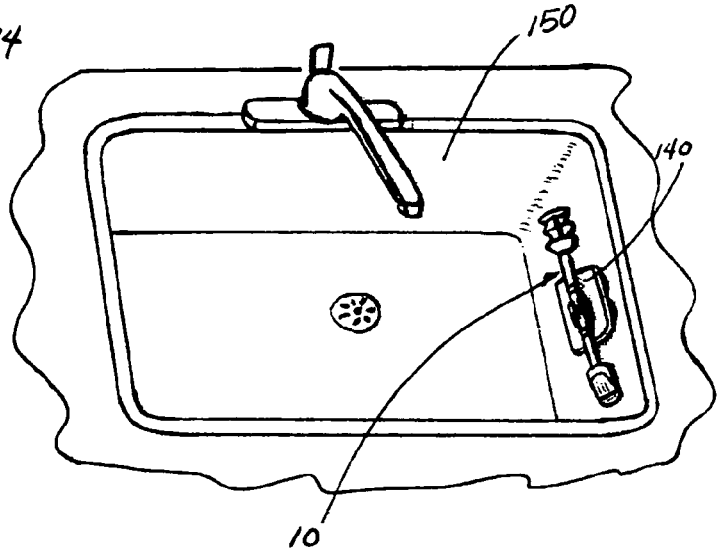
FIG. 20 is a view of the liquid dispenser in its holder mounted in a kitchen sink.

FIG. 20 shows the holder 138 and the universal liquid dispenser 10 located inside the sink 150 of any kitchen at home, factory or restaurant. The holder can be at any other place where a surface of objects needs to be cleaned.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A liquid dispenser comprising:

a handle member having a reservoir defined therein the reservoir for holding a liquid, the handle having sponge and scrubber ends, said ends each having male cylindrical sections with a resilient rubber ring around each of the male cylindrical sections;

an applicator sponge having a sponge-end protuberance defining an internal cylinder for receiving the male cylindrical section of the sponge end, the sponge-end protuberance having handle-receiving and sponge-attaching ends;

a cylindrical groove, at the handle-receiving end, the groove defined around the internal circumference of the sponge-end protuberance for receiving the resilient rubber ring of the male cylindrical section of the sponge-end of the handle; and a flange, at the sponge-attaching end, the flange defined around the internal circumference of the sponge-end protuberance for receiving a second resilient ring, said applicator sponge attached to the sponge end of the handle member; and an applicator scrubber having a scrubber-end protuberance defining an internal cylinder for receiving the male cylindrical section of the scrubber end, the scrubber-end protuberance having handle-receiving and scrubber-attaching ends;

a cylindrical groove, at the handle-receiving end, the groove defined around the internal circumference of the scrubber-end protuberance for receiving the resilient rubber ring of the male cylindrical section of the scrubber-end of the handle; and a flange, at the scrubber-attaching end, the flange defined around the internal circumference of the scrubber-end protuberance for receiving a second resilient ring said applicator scrubber attached to the scrubber end of the handle member.

2. The liquid dispenser of claim 1, wherein the handle has a general cylindrical sidewall and fabricated of a translucent material.

3. The liquid dispenser of claim 2, wherein the handle has a plurality of non-slippery rubber rings disposed around the length of the handle, and a wide non-slippery band generally disposed around the center of the handle.

4. A holder for the liquid dispenser of claim 3, comprising:

a frame having suction and clamp sides;

a plurality of suction pads attached to the suction side of the frame; and a clamp for clamping the wide non-slippery band of the liquid dispenser, the clamp attached to the clamp side of the frame.

5. The holder of claim 4, wherein the frame is fabricated from plastic.

6. The holder of claim 4, further comprising a piece of plastic for connecting the clamp to the frame.

7. The liquid dispenser of claim 1, wherein the applicator scrubber is made from a non-scratch scour pad material with a sponge material layer, dividing the non-scratch scour pad material into distal and proximal scour sections, relative to the handle, thereby allowing the movement of the distal scour section, and liquid to permeate and exist through the sponge material layer.

8. The liquid dispenser of claim 7, the applicator scrubber further comprising:

a housing having an upper wall abutting the scrubber-end protuberance, the upper wall defining an upper wall hole;

a base wall defining a base wall bore and further defining a pair of base wall holes on either side of the base wall bore;

a truncated cylindrical wall attached at one end to the upper wall, and at the other to the base wall; and a valve assembly, contained in the housing, the valve assembly to regulate the flow of liquid from the reservoir to the exterior of the scrubber.

9. The liquid dispenser of claim 8, the valve assembly comprising:

a plate, at the center of the plate defining a hole and further defining a bore to one side of the hole;

a valve stem received in the bore of the plate, and extending through the base wall bore of the housing;

a first round plate attached to the valve stem on the interior of the base wall;

a rubber plate attached to the valve stem and flush with the first round plate and abutting the interior surface of the base wall;

a second round plate attached to the valve stem on the exterior of the base wall; and a spring around the valve stem, wherein the spring pushes the rubber plate against the base wall bore, thereby preventing liquid from exiting the reservoir.

10. The liquid dispenser of claim 7, wherein the applicator scrubber is generally cylindrical and has one side with an inclined surface of twenty degrees, with the scrubber narrowing at the end distal from the handle.

11. The liquid dispenser of claim 1, wherein the applicator sponge is made from a sponge material.

12. The liquid dispenser of claim 1, the applicator sponge further comprising:

a housing having an upper wall abutting the sponge-end protuberance, the upper wall defining an upper wall hole;

a base wall defining a base wall bore and further defining a pair of base wall holes on either side of the base wall bore;

a truncated cylindrical wall attached at one end to the upper wall, and at the other to the base wall;

and a valve assembly to regulate the flow of liquid from the reservoir to the exterior of the sponge.

13. The liquid dispenser of claim 12, the valve assembly comprising:

a plate, at the center of the plate defining a hole and further defining a bore;

a valve stem received in the bore of the plate, and extending through the base wall bore;

a first round plate attached to the valve stem on the interior of the base wall;

a rubber plate attached to the valve stem and flush with the first round plate and abutting the interior surface of the base wall;

a second round plate attached to the valve stem on the exterior of the base wall; and a spring around the valve stem, wherein the spring pushes the rubber plate against the base wall bore, thereby preventing liquid from exiting the reservoir.

14. The liquid dispenser of claim 1, wherein the applicator sponge further comprises:

a plurality of waved surfaces; and a plurality of wave filaments between the waves of the waved surfaces.

15. The liquid dispenser of claim 14, wherein the applicator sponge is generally cylindrical and has one side with an inclined surface of twenty degrees, with the sponge narrowing at the end distal from the handle.

16. A parts kit for the liquid dispenser of claim 1, comprising:

a replaceable sponge; and a replaceable scrubber.

* * * * *